US011306529B2

(12) United States Patent
Hong et al.

(10) Patent No.: US 11,306,529 B2
(45) Date of Patent: Apr. 19, 2022

(54) SPACE ADJUSTMENT SYSTEM AND CONTROL METHOD THEREOF

(71) Applicants: Ruei-Hong Hong, Taipei (TW); Wen-Yi Chiu, Taipei (TW); Wei-Jun Wang, Taipei (TW); Po-Chun Liu, Taipei (TW)

(72) Inventors: Ruei-Hong Hong, Taipei (TW); Wen-Yi Chiu, Taipei (TW); Wei-Jun Wang, Taipei (TW); Po-Chun Liu, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 478 days.

(21) Appl. No.: 16/286,625

(22) Filed: Feb. 27, 2019

(65) Prior Publication Data

US 2020/0165859 A1 May 28, 2020

(30) Foreign Application Priority Data

Nov. 23, 2018 (TW) ..... 107141764

(51) Int. Cl.
*E05F 15/73* (2015.01)
*E05F 15/77* (2015.01)
*E06B 9/24* (2006.01)

(52) U.S. Cl.
CPC ..... *E05F 15/73* (2015.01); *E05F 15/77* (2015.01); *E05F 2015/767* (2015.01); *E05Y 2900/132* (2013.01); *E06B 2009/2464* (2013.01)

(58) Field of Classification Search
CPC . E05F 15/70–77; E05F 2015/767; B60J 3/04; E06B 2009/2464; E05Y 2900/132
See application file for complete search history.

(56) References Cited

U.S. PATENT DOCUMENTS 5,164,856 A * 11/1992 Zhang ..... E06B 9/24 359/486.02
9,586,461 B2 * 3/2017 Okuda ..... B32B 17/10155
9,642,219 B2 * 5/2017 Mead ..... H05B 47/16
(Continued)

FOREIGN PATENT DOCUMENTS

CN 101751209 6/2010
CN 203812529 9/2014
(Continued)

OTHER PUBLICATIONS

English translation of JPH03253682 (Year: 1991).*
(Continued)

*Primary Examiner* — Justin B Rephann
(74) *Attorney, Agent, or Firm* — JCIPRNET

(57) ABSTRACT

A space adjustment system and a control method thereof are provided. The space adjustment system includes a body, at least one door leaf, at least one motor, and a control circuit. The door leaf is movably disposed at the body. The door panel of each door leaf includes a panel. The motor can drive the motion of the door leaf. The control circuit is coupled with the panel of the door leaf and motor. The control circuit controls the motor to drive the door leaf, and adjusts the transparency or display function of the panel on the corresponding door leaf in response to a location of the door leaf. Accordingly, multiple space type can be created.

14 Claims, 15 Drawing Sheets

(56) References Cited

U.S. PATENT DOCUMENTS

| | | | | |
|---|---|---|---|---|
| 10,026,363 | B2 * | 7/2018 | Iwakawa | B60J 3/04 |
| 10,293,666 | B2 * | 5/2019 | Choi | B60J 3/04 |
| 2008/0231934 | A1 * | 9/2008 | Knafou | B32B 17/10532 359/245 |
| 2009/0015740 | A1 * | 1/2009 | Sagitov | B60J 3/04 349/16 |
| 2009/0027759 | A1 * | 1/2009 | Albahri | E06B 9/24 359/277 |
| 2010/0315693 | A1 * | 12/2010 | Lam | G02B 5/223 359/241 |
| 2016/0035160 | A1 * | 2/2016 | Friedli | B66B 1/468 340/5.7 |
| 2016/0082812 | A1 * | 3/2016 | Okuda | B32B 17/10761 49/323 |
| 2016/0083997 | A1 * | 3/2016 | Seamon | E06B 9/24 52/204.5 |
| 2016/0104437 | A1 * | 4/2016 | Iwakawa | B60J 3/04 345/690 |
| 2016/0208545 | A1 * | 7/2016 | Baba | E06B 9/24 |
| 2016/0295667 | A1 * | 10/2016 | Mead | H05B 47/115 |
| 2018/0079284 | A1 * | 3/2018 | Choi | G02F 1/0121 |
| 2020/0226864 | A1 * | 7/2020 | Oh | E05F 15/73 |

FOREIGN PATENT DOCUMENTS

| | | |
|---|---|---|
| CN | 205607008 | 9/2016 |
| CN | 106223776 | 12/2016 |
| CN | 206769711 | 12/2017 |
| JP | H03253682 | 11/1991 |
| TW | 201349217 | 12/2013 |
| TW | M477635 | 5/2014 |
| TW | I463451 | 12/2014 |
| TW | M515808 | 1/2016 |
| TW | 201720345 | 6/2017 |
| TW | M543283 | 6/2017 |
| TW | M548396 | 9/2017 |

OTHER PUBLICATIONS

"Office Action of Taiwan Counterpart Application," dated May 7, 2019, p. 1-p. 19.

Office Action of Taiwan Counterpart Application, dated Mar. 8, 2021, pp. 1-13.

* cited by examiner

SPACE ADJUSTMENT SYSTEM AND CONTROL METHOD THEREOF

CROSS-REFERENCE TO RELATED APPLICATION

This application claims the priority benefit of Taiwan application serial no. 107141764, filed on Nov. 23, 2018. The entirety of the above-mentioned patent application is hereby incorporated by reference herein and made a part of this specification.

BACKGROUND OF THE DISCLOSURE

Field of the Disclosure

The present disclosure relates to control of door leaf, and more particularly to a space adjustment system and a control method thereof related to a door leaf.

Description of Related Art

Door is one of the important elements for interior decoration, and it is mainly located at the entrance. The user may open the door to connect two spaces and close it to isolate the two spaces. Nowadays, the design and development of door is nothing more than anti-theft or security. It can be seen that there is a need to propose innovative functions and breakthrough changes to existing doors.

SUMMARY OF THE DISCLOSURE

The disclosure provides a space adjustment system and a control method thereof, which are adaptable for various scenarios through opening or closing two door leaves to form different spaces and adjusting the transparency of the door leaf combined with presenting images on the door leaf.

The space adjustment system of the present disclosure includes a body, a door leaf, a motor and a control circuit. The door leaf is movably disposed on the body, and the panel of each door leaf includes a transparency-adjustable panel. The motor may drive the motion of the door leaf respectively. The control circuit is coupled to the transparency-adjustable panel of the door leaf and the motor. The control circuit controls the motor to drive the door leaf, and the transparency of transparency-adjustable panel of the corresponding door leaf is adjusted according to the location of the door leaf.

In an embodiment of the disclosure, a depth camera is further included, which is coupled to the control circuit and configured to capture at least one image of an external object.

In an embodiment of the disclosure, the control circuit determines the motion of the external object in the image, and controls the motor to drive the door leaf according to the motion of the external object.

In an embodiment of the disclosure, the control circuit determines the relative position of the external object in the image relative to the door leaf.

In an embodiment of the disclosure, a wireless communication receiver is further included, which is coupled to the control circuit and configured to receive the first wireless command signal, and the first wireless command signal is related to the driving of the door leaf. The control circuit controls the motor to drive the door leaf according to the first wireless command signal.

In an embodiment of the disclosure, a distance sensor is further included, which is coupled to the control circuit and used to sense the relative position of the external object.

In an embodiment of the disclosure, a first projection device and a second projection device are further included. The first projection device is coupled to the control circuit and configured to project the first image in the first direction. The second projection device is coupled to the control circuit and configured to project the second image in the second direction, and the first direction is perpendicular to the second direction.

A control method of space adjustment of the present disclosure includes the following steps. A movable door leaf is provided, and a motor drives the motion of the door leaf respectively. The door panel of each door leaf includes a transparency-adjustable panel. The motor is controlled to drive the door leaf. The transparency of the transparency-adjustable panel is adjusted according to the transparency of the corresponding door leaf.

In an embodiment of the disclosure, the step of controlling the motor to drive the door leaf includes the following step. A depth camera is included, which is configured to capture an external image.

In an embodiment of the disclosure, the step of controlling the motor to drive the door leaf includes the following steps: determining the motion of external object in the external image, driving the motor to drive the door leaf according to the motion of the external object.

In an embodiment of the disclosure, the step of controlling the motor to drive the door leaf includes the following steps: determining the relative position of the external object the external image relative to the door leaf; if the relative position of the external object is within the moving range of the door leaf, disabling driving of the door leaf; if the relative position of the external object is not within the moving range of the door leaf, driving the door leaf.

In an embodiment of the disclosure, the step of controlling the motor to drive the door leaf includes the following steps: determining that the motion of the external object corresponds to a certain door leaf, determining whether the relative position of the object is within the moving range of the certain door leaf.

In an embodiment of the disclosure, the step of controlling the motor to drive the door leaf includes the following step: not determining whether the relative position of the external object is within the moving range of other door leafs.

In an embodiment of the disclosure, the step of adjusting the transparency of the transparency-adjustable panel of the corresponding door leaf includes the following steps: when the door leaf is in the closed position, determining the relative position of the external object in the external image relative to the door leaf; if the relative position of the external object is within the moving range of the door leaf, adjusting the transparency of the transparency-adjustable panel of the corresponding door leaf to be smaller than the threshold.

In an embodiment of the disclosure, the step of controlling the motor to drive the door leaf includes the following step: providing a wireless communication receiver, which is configured for receiving wireless command signals.

In an embodiment of the disclosure, the wireless command signal is a first wireless command signal, which is related to driving of the door leaf. The control method further comprises controlling the motor to drive the door leaf according to the first wireless command signal.

In an embodiment of the disclosure, the step of controlling the motor to drive the door leaf includes the following steps:

providing a distance sensor for sensing the relative position of the external object; if the relative position of the external object is within the moving range of the door leaf, disabling driving of the door leaf; if the relative position of the external object is not within the moving range of the door leaf, driving the door leaf.

In an embodiment of the disclosure, the wireless command signal is a second wireless command signal, which is related to presenting image.

In an embodiment of the disclosure, the door leaf includes a first door leaf and a second door leaf, and the step of adjusting the transparency of the transparency-adjustable panel of the corresponding door leaf includes the following steps: providing the first projection device for projecting the first image in the first direction, providing the second projection device for projecting the second image in the second direction, and the first direction is perpendicular to the second direction.

In an embodiment of the disclosure, the step of adjusting the transparency-adjustable panel of the corresponding door leaf includes the following steps: when the first door leaf and the second door leaf are closed together, adjusting the transparency of the transparency-adjustable panel of the first door leaf to be smaller than the threshold, and adjusting the transparency of the transparency-adjustable panel of the second door leaf to be smaller than the threshold, projecting the first image to the transparency-adjustable panel of the first door leaf and the transparency-adjustable panel of the second door leaf through the first projection device, and stopping the projection of the second image through the second projection device.

In an embodiment of the disclosure, the step of adjusting the transparency of the transparency-adjustable panel of the corresponding door leaf includes the following steps: when the first door leaf and the second door leaf are vertically opened, adjusting the transparency of the transparency-adjustable panel of the first door leaf to be smaller than the threshold, and adjusting the transparency of the transparency-adjustable panel of the second door leaf to be smaller than the threshold, projecting the first image to the transparency-adjustable panel of the first door leaf through the first projection device, and simultaneously projecting the second image to the transparency-adjustable panel of the second door leaf through the second projection device.

In an embodiment of the disclosure, the step of adjusting the transparency of the transparency-adjustable panel of the corresponding door leaf includes the following steps: when the first door leaf and the second door leaf are opened in parallel, adjusting the transparency of the transparency-adjustable panel of the second door leaf to be smaller than the threshold, stopping projecting the first image through the first projection device, and projecting the second image to the transparency-adjustable panel of the second door leaf through the second projection device.

The space adjustment system of the present disclosure includes a body, a first door leaf, a second door leaf, a first motor, a second motor, and a control circuit. The first door leaf is pivoted to the body and has a first panel. The second door leaf is pivotally to the body and has a second panel. The first motor connects the first door leaf to the body. The second motor connects the second door leaf to the body. The control circuit is disposed in the body and electrically coupled to the first panel, the second panel, the first motor and the second motor. The control circuit controls the first panel and the second panel to display or not display images respectively, and controls the first motor and the second motor to drive or not drive the first door leaf and the second door leaf to rotate respectively.

In an embodiment of the disclosure, the first panel or the second panel is a transparency-adjustable panel.

In an embodiment of the disclosure, the first projection device and the second projection device are included and electrically coupled to the control circuit, and are configured to project image to the first panel or the second panel respectively.

In an embodiment of the disclosure, the first panel or the second panel is a waterproof display panel, a liquid crystal display panel, an organic light emitting display panel or an electrophoretic display panel.

In an embodiment of the disclosure, a depth camera is further included and electrically coupled to the control circuit for capturing an external image and sensing the motion or relative position of the external object.

In an embodiment of the disclosure, the distance sensor is included and electrically coupled to the control circuit for sensing the relative position of the external object.

In an embodiment of the present disclosure, the wireless communication receiver is further included and electrically coupled to the control circuit and configured to receive the wireless command signal and control the first panel, the second panel, the first motor and the second motor accordingly.

The control method of space adjustment of the present disclosure includes the following steps. A first door leaf and a second door leaf that are rotatable are provided, the first leaf has a first panel and the second leaf has a second panel, which are coplanar with each other. The user location is detected. It is determined whether the user location is within the moving range of the first door leaf.

In an embodiment of the disclosure, the following steps are further included. If the user position is within the moving range of the first door leaf, the first panel and the second panel are controlled to display the preset image together.

In an embodiment of the disclosure, the following steps are further included. If the user position is not within the moving range of the first door leaf, after the first rotation command signal is received, the first door leaf is driven to rotate.

In an embodiment of the disclosure, the first rotation command signal is a gesture command signal or a wireless command signal.

In an embodiment of the disclosure, the following steps are further included. It is determined whether the user location is within the moving range of the second door leaf.

In an embodiment of the disclosure, if the user position is within the moving range of the second door leaf, the second door leaf is fixed and perpendicular to the first door leaf after being rotated.

In an embodiment of the disclosure, the following steps are further included. The first panel is controlled to display the first image, and the second panel is controlled to display the second image.

In an embodiment of the disclosure, the following steps are further included. If the user position is not within the moving range of the second door leaf, after the second rotation command signal is received, the second door leaf is driven to rotate according to the second rotation command signal.

In an embodiment of the disclosure, the rotated second door leaf is parallel to the first door leaf after being rotated.

In an embodiment of the disclosure, the following steps are further included. The second panel is controlled to display the third image.

Based on the above, the space adjustment system and the control method thereof in the embodiments of the present disclosure open or close the door leaf through wireless remote controller or action operation to create different spatial types. When the door leaf is in a different position, the transparency of the transparency-adjustable panel of the door leaf may be changed in response to user's proximity or a position relative to another door leaf. In addition, the motion of the door leaf and the different transparency of the door leaf are combined with presenting image on the door leaf, thus providing more diverse use of scenarios.

In order to make the aforementioned features and advantages of the disclosure more comprehensible, embodiments accompanying figures are described in detail below.

DESCRIPTION OF EMBODIMENTS

Figure 1:
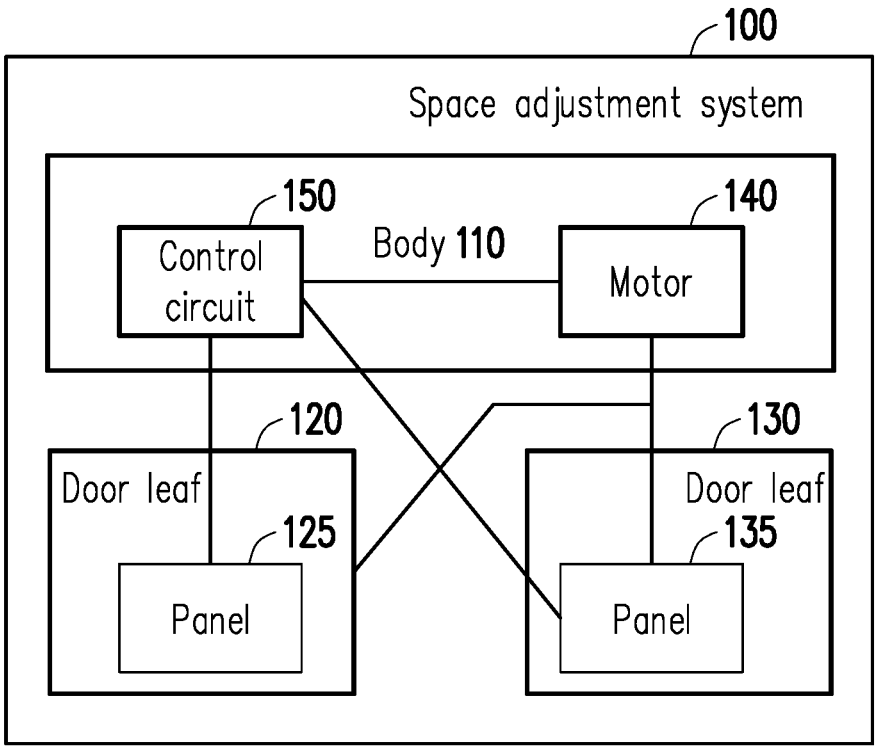
FIG. 1 is a block diagram of components of a space adjustment system according to an embodiment of the present disclosure.

FIG. 1 is a block diagram of components of a space adjustment system 100 according to an embodiment of the present disclosure. Referring to FIG. 1, the space adjustment system 100 includes at least but not limited to the body 110, the door leaves 120 and 130, the motor 140, and the control circuit 150.

The body 110 may be a jamb, a lintel, or a door frame of the above combination.

The door leaves 120 and 130 may be movably disposed or pivoted to the body 110 via hinged, folded, sliding, or rotary structures (e.g., slide rails, pivot joints, hinges, etc.). It should be indicated that the door panel of the door leaves 120 and 130 are respectively provided with panels 125 and 135. The panels 125 and 135 may be transparency-adjustable panel such as a dimming film or smart glass (for example, electro-optical liquid crystal glass, polymer liquid crystal dimming film, etc.), and the transparency thereof may be adjusted (e.g., completely transparent, non-transparent, or a certain level of transparency) in response to electricity, light or other control signals. The panels 125 and 135 may also be waterproof display panels, liquid crystal display panels, organic light emitting display (OLED) panels, or electrophoretic display panels to present an image. Alternatively, one of the panels 125 and 135 is a transparency-adjustable panel, and the other is a display panel. It should be noted that the number of the door leaf and the panel of this embodiment is two. However, in other embodiments, the number of the door leaf and the panel may be increased or decreased depending on needs, and it is likely that only some of the door leaves are provided with a panel.

The motor 140 may be various types of motors such as a servo motor, a linear motor, a stepper motor, and the like, and one or more motors 140 are connected to the door leaves 120 and 130. In the present embodiment, the motor 140 is used to drive the motion (e.g., rotate, slide, fold, etc.) of the door leaves 120 and 130 respectively.

The control circuit 150 may be a processing unit such as a CPU, a microcontroller, a chip, an application specific integrated circuit (ASIC), or a field programmable gate array (FPGA). The control circuit 50 is coupled to the panels 125 and 135 and the motor 140, thereby controlling the activation, deactivation or other functions (e.g., rotation, start-up time, change of transparency, display of images, etc.) of the panels 125 and 135 and the motor 140.

The door leaves 120 and 130 of the space adjustment system 100 of the embodiment of the present disclosure may be driven by the motor 140 to be automatically opened or closed. Moreover, the embodiments of the present disclosure provide panels 125 and 135 that change the visual presenting manner. If the transparency of the panels 125 and 135 (for example, the transparency-adjustable panel) is set to be completely non-transparent, the spaces on the opposite sides of the panels 120 and 130 are isolated. If the transparency of the panels 125 and 135 is set to be completely transparent, it makes the user feel that the spaces on the opposite sides of the door leaves 120 and 130 are connected. In addition, if an image is presented on the panels 125 and 135, a different visual experience will be provided. Proper control of these devices or components facilitates to create multiple spatial patterns and adapt to multiple scenarios.

Figure 2:
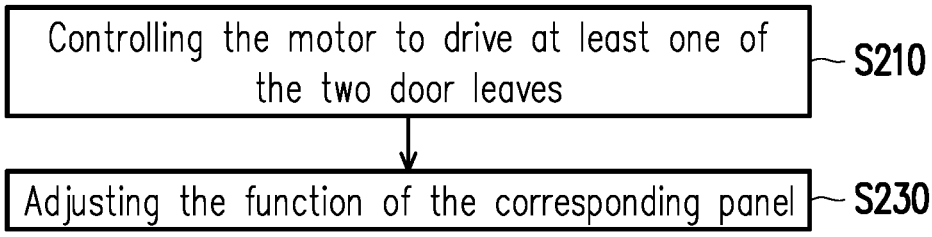
FIG. 2 is a flow chart of a control method according to an embodiment of the present disclosure.

To assist in understanding the operational flow of the embodiment, the following description will be made with reference to the device and mechanical components of the space adjustment system 100 of FIG. 1. FIG. 2 is a flow chart of a control method of the space adjustment system 100 according to an embodiment of the present disclosure. Referring to FIG. 2, in order to actually change the spatial connectivity, the control circuit 150 controls the motor 140 to drive at least one of the two door leaves 120 and 130 (step S210). In particular, depending on different moving manners (e.g., rotating, sliding, folding, etc.) of the door leaves 120 and 130, the control circuit 150 may control the motor 140 connected to the door leaves 120 and 130, thereby controlling one or both of the door leaves 120 and 130 to open or close. For example, the door leaf 120 is rotated 90 degrees clockwise, and the door leaf 130 is rotated 90 degrees counterclockwise, such that the door leaf 120 is away from the door leaf 130. When the door leaf 120 and/or 130 are opened, the external object can actually pass through the passage formed by the body 110 and the door leaves 120 and 130. When the door leaves 120 and 130 are closed, the external object cannot pass through the door leaves 120 and 130.

On the other hand, in order to visually change the spatial connectivity relationship, the control circuit 150 adjusts the function of the panel 125 or 135 on the corresponding door leaf 120 or 130 in response to the position of the door leaves 120 and 130 (step S230). For example, when the door leaves 120 and 130 are closed, the control circuit 150 adjusts the transparency of the panels 125 and 135 (for example, the transparency-adjustable panel) to be completely transparent so that the user can see the scene on the other side relative to the door leaves 120 and 130, but the external object cannot actually pass through the door leaves 125 and 135. When the control circuit 150 adjusts the transparency of the panels 125 and 135 to completely non-transparent, the visual perception and the external object cannot pass through the door leaves 125 and 135, thus the door leaves 120 and 130 are isolated from each other in opposite sides. When the control circuit 150 adjusts the transparency of the panels 125 and 135 to 70%, as compared to complete transparency, the user can roughly observe the external object appearing on the other side of the door leaves 120, 130 and the approximate location of the external object. In addition, when the door leaf 120 and/or 130 are opened, the control circuit 150 may also adjust the transparency so that the user can have different visual perceptions in different directions, and the user can actually see the scene on the opposite side in a part of the area.

On the other hand, the control circuit 150 may present the images on the panels 125 and 135 through projection or direct display. In addition to providing information, different scenes such as waterfalls, grasslands, cities, etc. may be provided corresponding to different situations, the visual perception of spatial change may also be influenced.

In order to facilitate the understanding of the spirit of the embodiments of the present disclosure, the scenarios of application of different space adjustment systems will be described in detail below.

Figure 3:
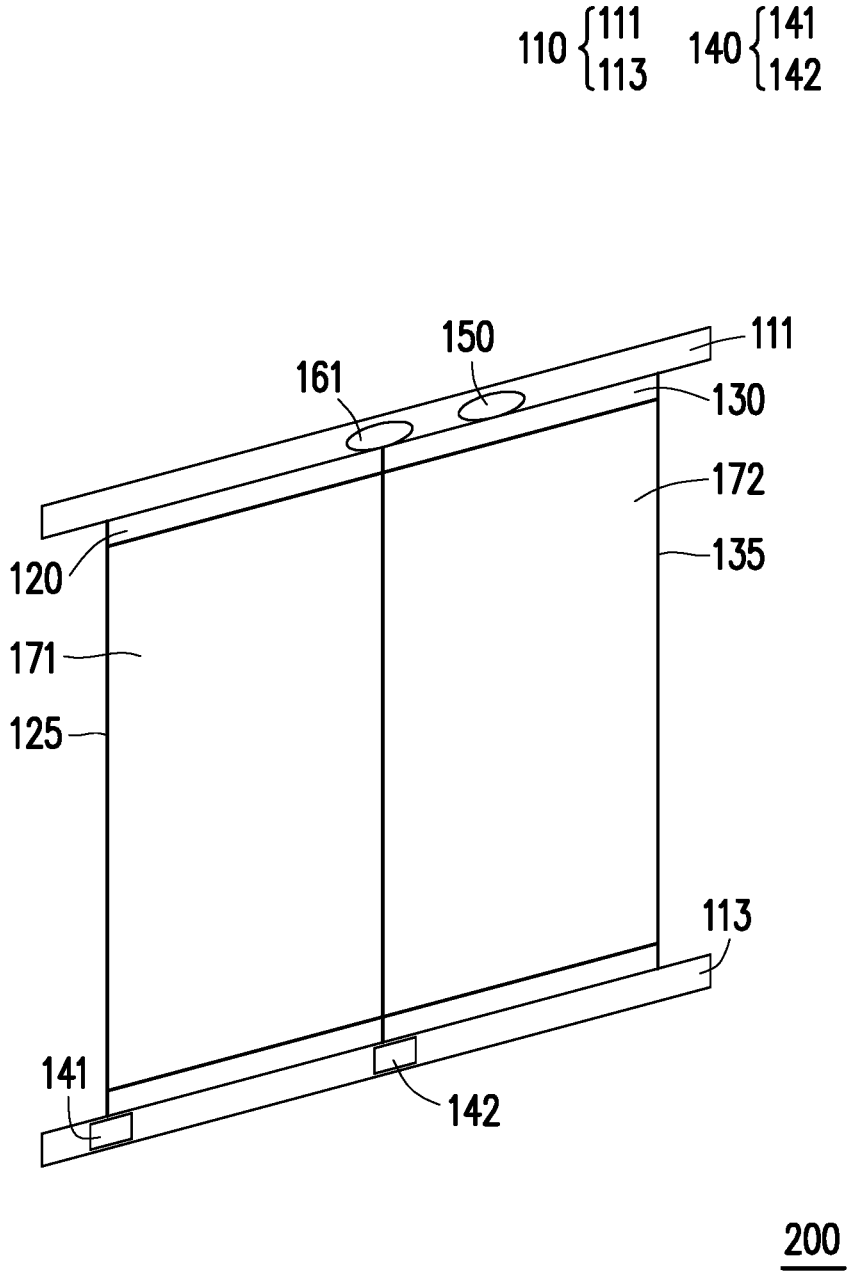
FIG. 3 is a schematic view of a space adjustment system according to a first embodiment of the present disclosure.

FIG. 3 is a schematic view of a space adjustment system 200 according to a first embodiment of the present disclosure. Referring to FIG. 3, the body 110 of the space adjustment system 200 includes an upper door frame 111 and a lower door frame 113 respectively located on the upper and lower sides of the door leaves 120 and 130. The panels 125 and 135 of the present embodiment are implemented as display panels 171 and 172. The door panel of the door leaf 120 is provided with a display panel 171, and the door panel of the door leaf 130 is provided with a display panel 172. The area of the display panels 171 and 172 may vary depending on the needs, and the higher the proportion of the display panel in the door leaves 120 and 130, the higher the opportunity to enhance the visual experience. The motor 140 includes a first motor 141 and a second motor 142 for respectively controlling the door leaves 120 and 130. The space adjustment system 200 further includes a depth camera 161. The depth camera 161 is coupled to the control circuit 150. The depth camera 161 captures image of a specific region and acquires one or more external images, and can obtain depth information of an external object.

Figure 4:
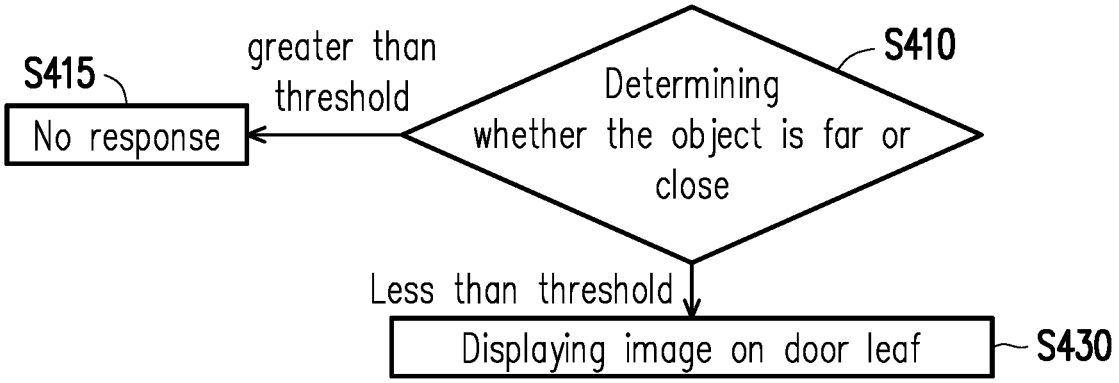
FIG. 4 is a flow chart of a control method according to a first embodiment of the present disclosure.

FIG. 4 is a flow chart of a control method according to a first embodiment of the present disclosure. Referring to FIG. 4, it is assumed that the door leaves 120 and 130 are closed together (co-parallel to each other), and the control circuit 150 determines the relative position of the external object in the external image obtained by the depth camera 161 relative to the door leaves 120 and 130 to determine the distance of the external objects (step S410). If the distance between the external object and the door leaves 120 and 130 exceeds the threshold (for example, 30, 40, 50 cm, etc.), the space adjustment system 200 does not respond (step S415). If the distance between the external object and the door leaves 120 and 130 does not exceed the threshold, the control circuit 150 displays the image (for example, preset image such as picture and video) on the panels 171 and 172 (both or either one of them) of the corresponding door leaves 120 and 130, such that the image is presented on the door panel of the door leaves 120 and/or 130 (step S430). It should be noted that the depth camera 161 of the embodiment provides an external image to the control circuit 150, and also determines the position and motion of the external object. In some embodiments, the space adjustment system 200 may also be additionally provided with a distance sensor to sense the relative position of the external object.

Figure 5:
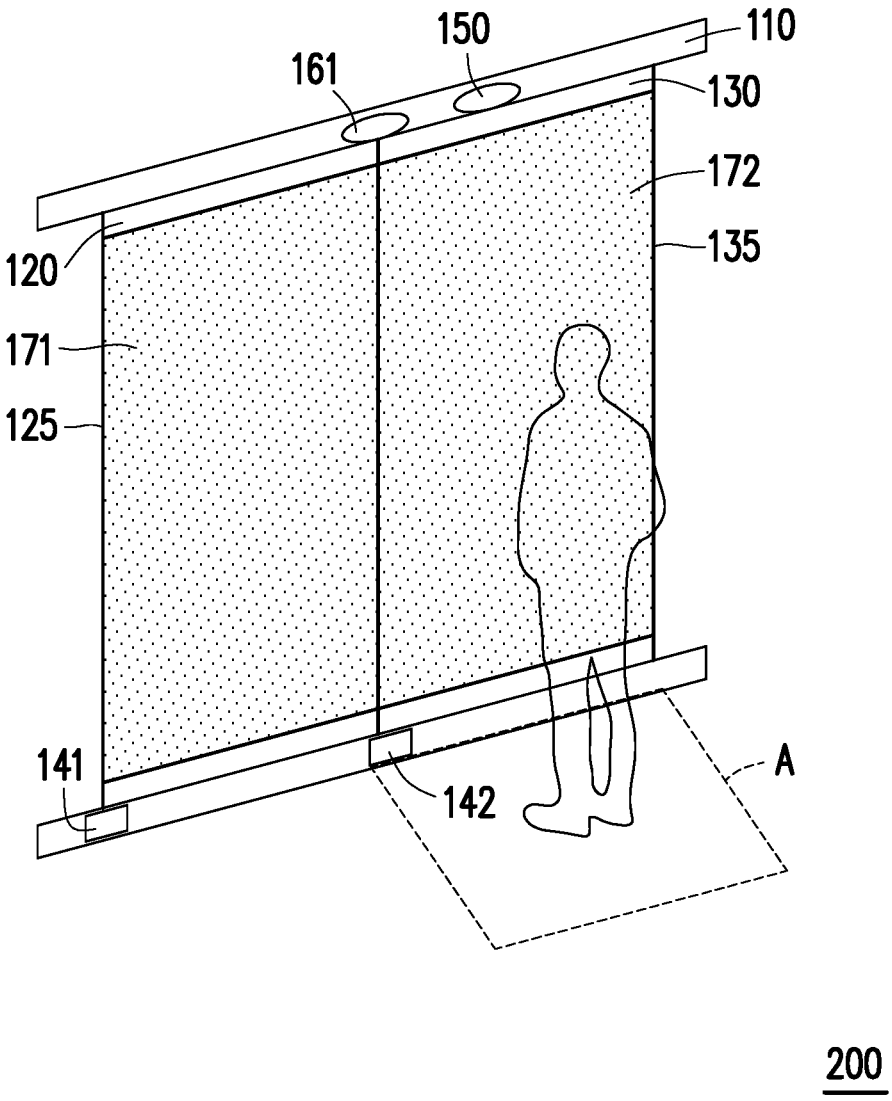
FIG. 5 is a schematic view of a space adjustment system according to a first embodiment of the present disclosure.

For example, FIG. 5 is a schematic view of a space adjustment system 200 according to a first embodiment of the present disclosure. Referring to FIG. 5, the position of the user is located within the moving range A (for example, 15 cm away from the door leaf 130) of the door leaf 130, and the panels 125 and 135 can display images. On this occasion, the two door leaves 120 and 130 are able to present a display image with a larger area (i.e., form an audiovisual space), thereby providing a large-area visual experience (e.g., playing movies, sports events, tutorial videos, concerts, wild scenery, etc.).

Figure 6:
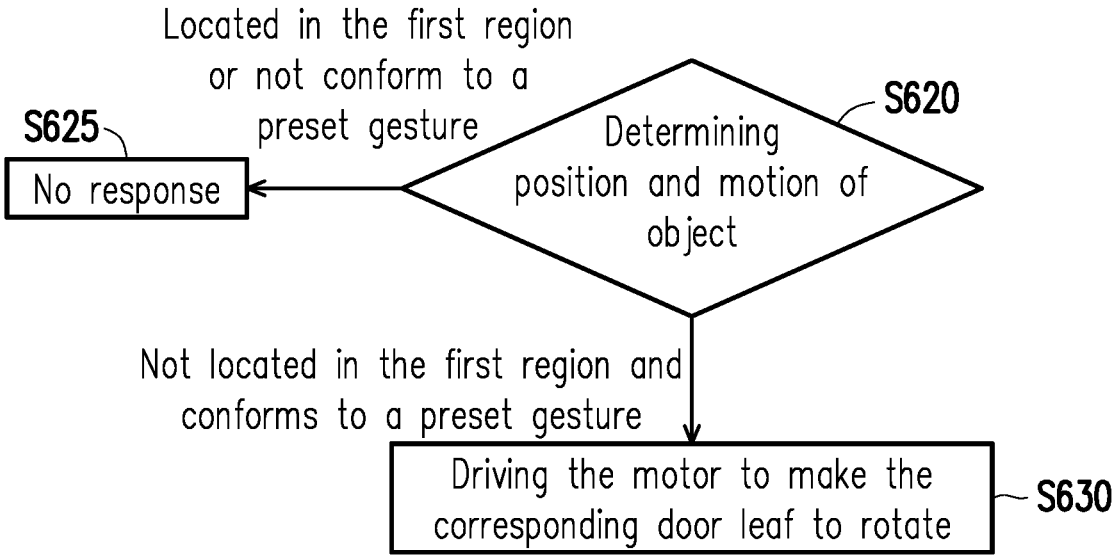
FIG. 6 is a flow chart of a control method according to a first embodiment of the present disclosure.

FIG. 6 is a flow chart of a control method according to a first embodiment of the present disclosure. Referring to FIG. 6, the embodiment controls the motor 140 to drive the door leaves 120 and/or 130 according to the motion of the external object. Specifically, the control circuit 150 determines the position and motion/movement (for example, hand swinging, person in movement, head shaking, etc.) of the external object according to the external image acquired by the depth camera 161 (step S620). When the door leaves 120 and/or 130 are in the closed position shown in FIG. 5, the control circuit 150 determines the relative position of the external object in the external image relative to the door leaves 120 and/or 130. If the relative position of the external object is located in the first region (for example, the moving range A shown in FIG. 5), or the movement does not conform to the first preset gesture (for example, the hand swings to the right, the hand waves left and right, etc.), the space adjustment system 200 does not respond (step S625), such that the door leaves 120 and/or 130 are not obstructed by external object due to opening. If the position of the external object is not located in the first region and the movement conforms to the first preset gesture (corresponding to the first rotation command signal), the control circuit 150 receives the first rotation command signal and drives the motor 140 accordingly to make the corresponding door leaves 120 and 130 to open (e.g., the door is opened rotationally in the embodiment) (step S630). It should be noted that in other embodiments, the triggering condition of the door leaves 120 and 130 may be that the movement of the external object conforms to the specific movement of the specific part of the body.

Figure 7:
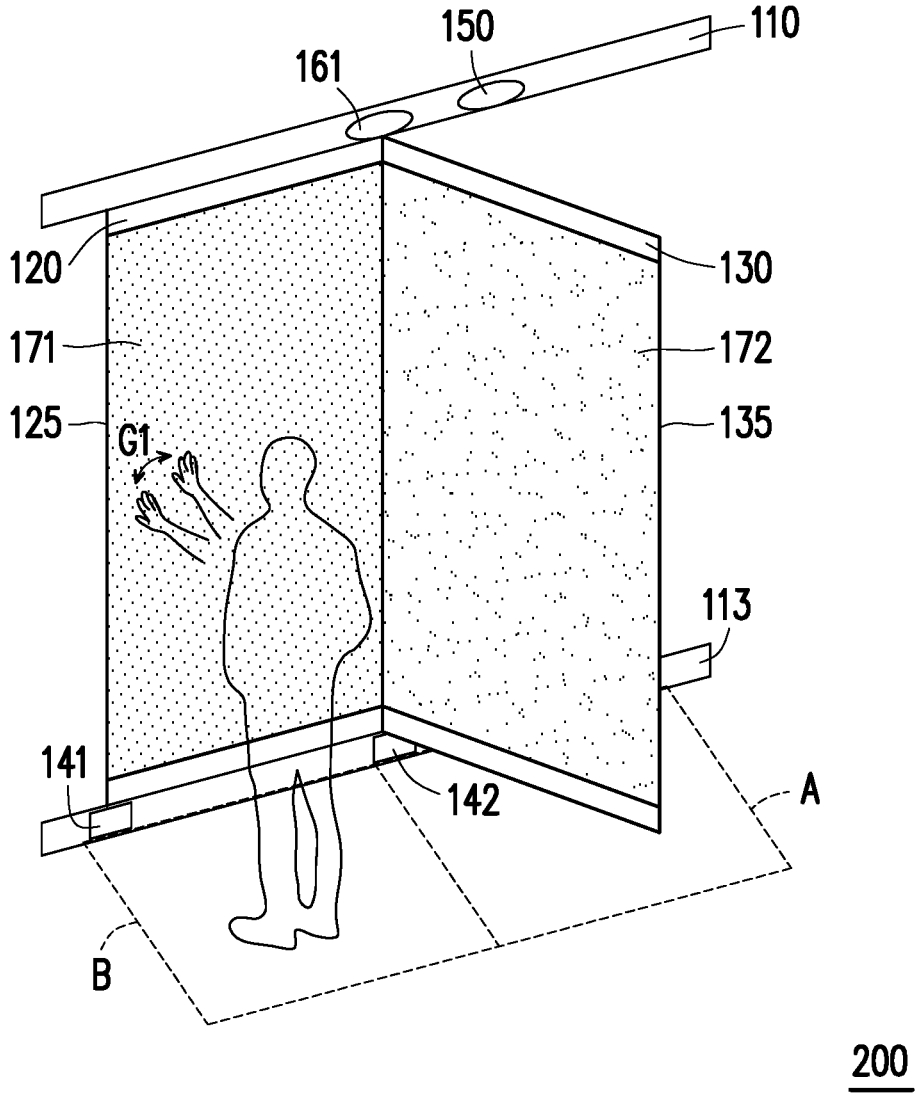
FIG. 7 is a schematic view of a space adjustment system according to a first embodiment of the present disclosure.

For example, FIG. 7 is a schematic view of a space adjustment system according to a first embodiment of the present disclosure. Referring to FIG. 7, in the embodiment, the control circuit 150 further determines that the motion of the external object corresponds to the door leaf 130, and determines whether the relative position of the external object is located in the moving range A (its width is approximately equal to the door leaf 130), and does not determine whether the relative position of the external object is within the moving range B (its width is approximately equal to the door leaf 120) of the door leaf 120. As shown in the drawing, the control circuit 150 may confirm that the user is not located in the moving range A of the door leaf 130. When the control circuit 150 detects from the external image that the user's gesture G1 is swung from right to left, the control circuit 150 drives the motor 142 to open the door leaf 130 in a clockwise direction, such that the door leaf 130 rotates 90 degrees (this angle may be changed as needed) and then become perpendicular to the door leaf 120. On this occasion, if a shower device (for example, a shower head, a faucet, etc.) is provided, and the display panels 171 and/or 172 present a waterfall image, a shower space with privacy and resistant to splash of water can be created (i.e., forming a shower space). Alternatively, a dressing space may be created. It should be noted that the display panels 171 and 172 may also display different images simultaneously.

Figure 8:
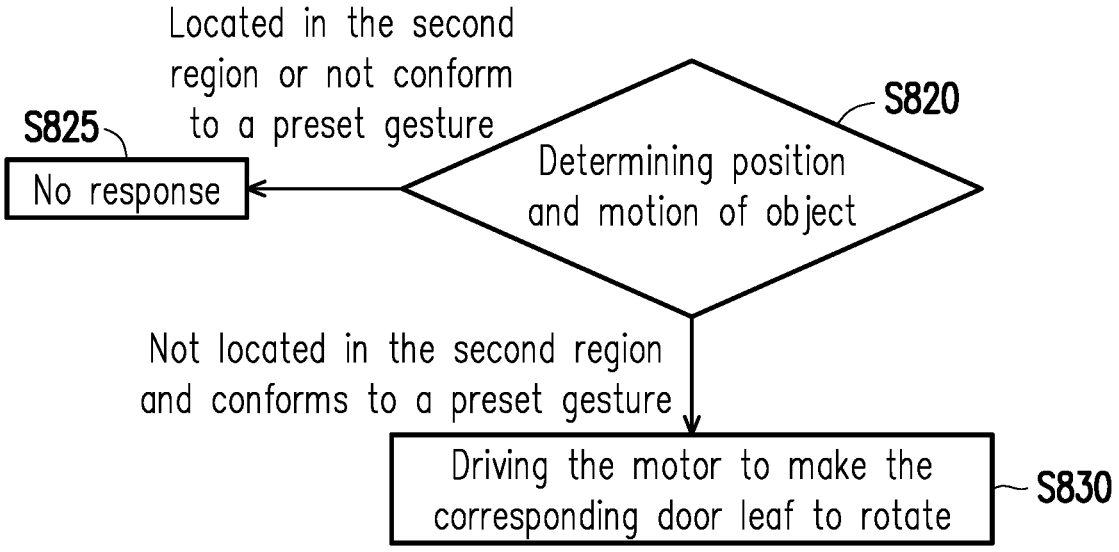
FIG. 8 is a flow chart of a control method according to a first embodiment of the present disclosure.

FIG. 8 is a flow chart of a control method according to a first embodiment of the present disclosure. Referring to FIG. 8, the control circuit 150 continuously determines the position and motion/movement (for example, hand waving, person in movement, head swinging, etc.) of the external object according to the external image acquired by the depth camera 161 (step S820). On this occasion, the door leaf 120 and the door leaf 130 are vertically opened (the door leaf 120 is perpendicular to the door leaf 130 as shown in FIG. 7), if the position of the external object is located in the second region (for example, the moving range B shown in FIG. 7), or if the motion does not conform to the second preset gesture (e.g., hand waving upward, hand waving downward, etc.) (corresponding to the second rotation command signal), the space adjustment system 200 does not respond (step S825), such that the door leaves 120 and/or 130 is not obstructed by an external object due to opening (on this occasion, the door leaf 120 is fixed and perpendicular to the door leaf 130 after the rotation of step S630, as shown in FIG. 7). If the position of the external object is not located in the second region and the motion conforms to the second preset gesture, the control circuit 150 receives the second rotation command signal and drives the motor 140 accordingly, such that the corresponding door leaves 120 and 130 are opened together (e.g., the door is opened rotationally in the embodiment) (step S830), and the rotated door leaf 120 is parallel to the door leaf 130 rotated in step S630.

Figure 9:
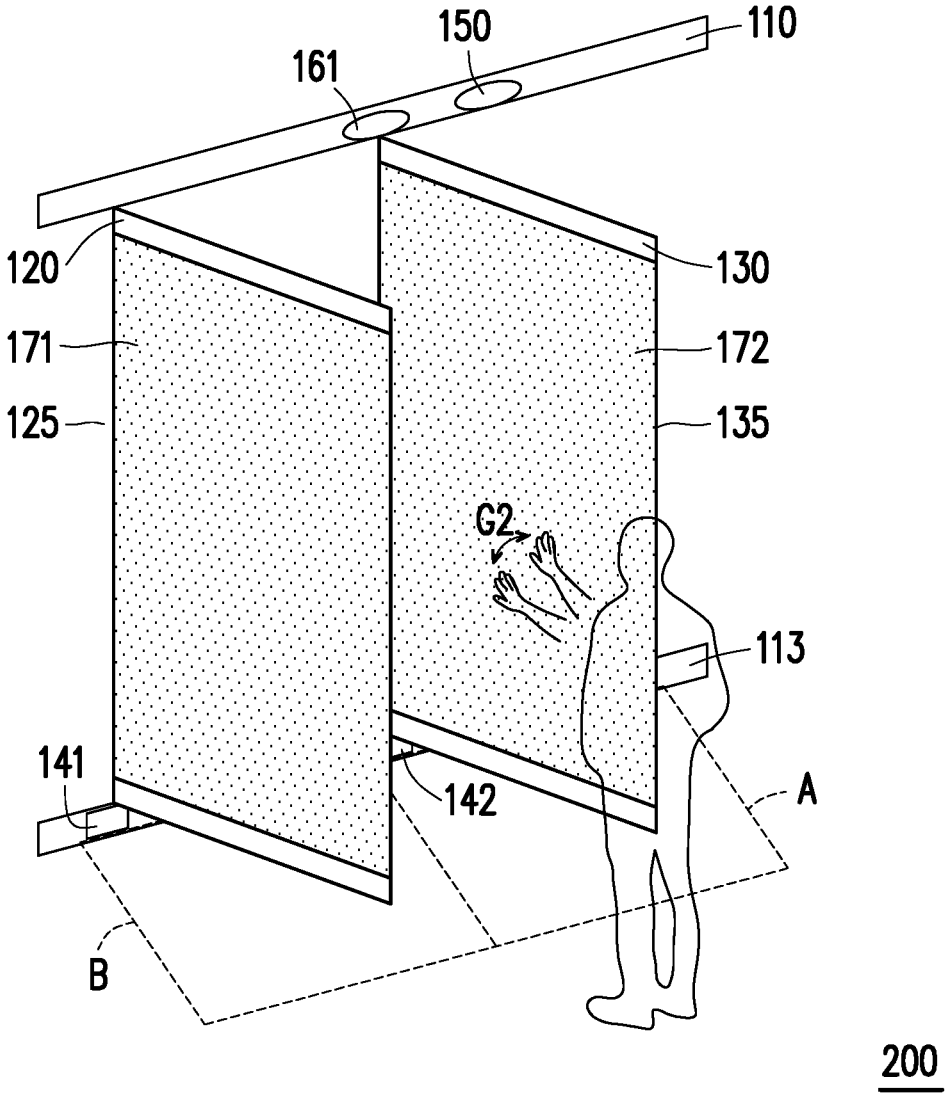
FIG. 9 is a schematic view of a space adjustment system according to a first embodiment of the present disclosure.

For example, FIG. 9 is a schematic view of a space adjustment system 200 according to a first embodiment of the present disclosure. Referring to FIG. 9, in the embodiment, the control circuit 150 further determines that the motion of the external object corresponds to the door leaf 120, and determines whether the relative position of the external object is located in the moving range B of the door leaf 120, and does not determine whether the relative position of the external object is within the moving range A of the door leaf 130. As shown in the drawing, the control circuit 150 may confirm that the user is not located in the moving range B of the door leaf 120, and the control circuit 150 detects from the external image that the user's gesture G2 is swung from left to right, then the control circuit 150 drives the motor 142 to open the door leaf 120 in a clockwise direction, such that the door leaf 120 rotates 90 degrees and becomes parallel to the door leaf 130 (i.e., both of them are opened), and forms a passage (i.e., forming an accessible space). On this occasion, the display panels 171 and 172 may collectively display the same or different images.

It should be noted that the control circuit 150 may also close the door leaves 130 and/or 120 or adjust the images of the display panels 171 and 172 according to the movement of external object in the external image. Moreover, when the door leaves 120 and 130 are closed, in response to the user moving away from the moving ranges A, B of the door leaves 120 and 130, the control circuit 150 may change the images of the door panels 125 and 135 (both or either one of them) into other content, and the display panel 171 or 172 stops presenting images on the corresponding door leaves 120 and/or 130.

Figure 10:
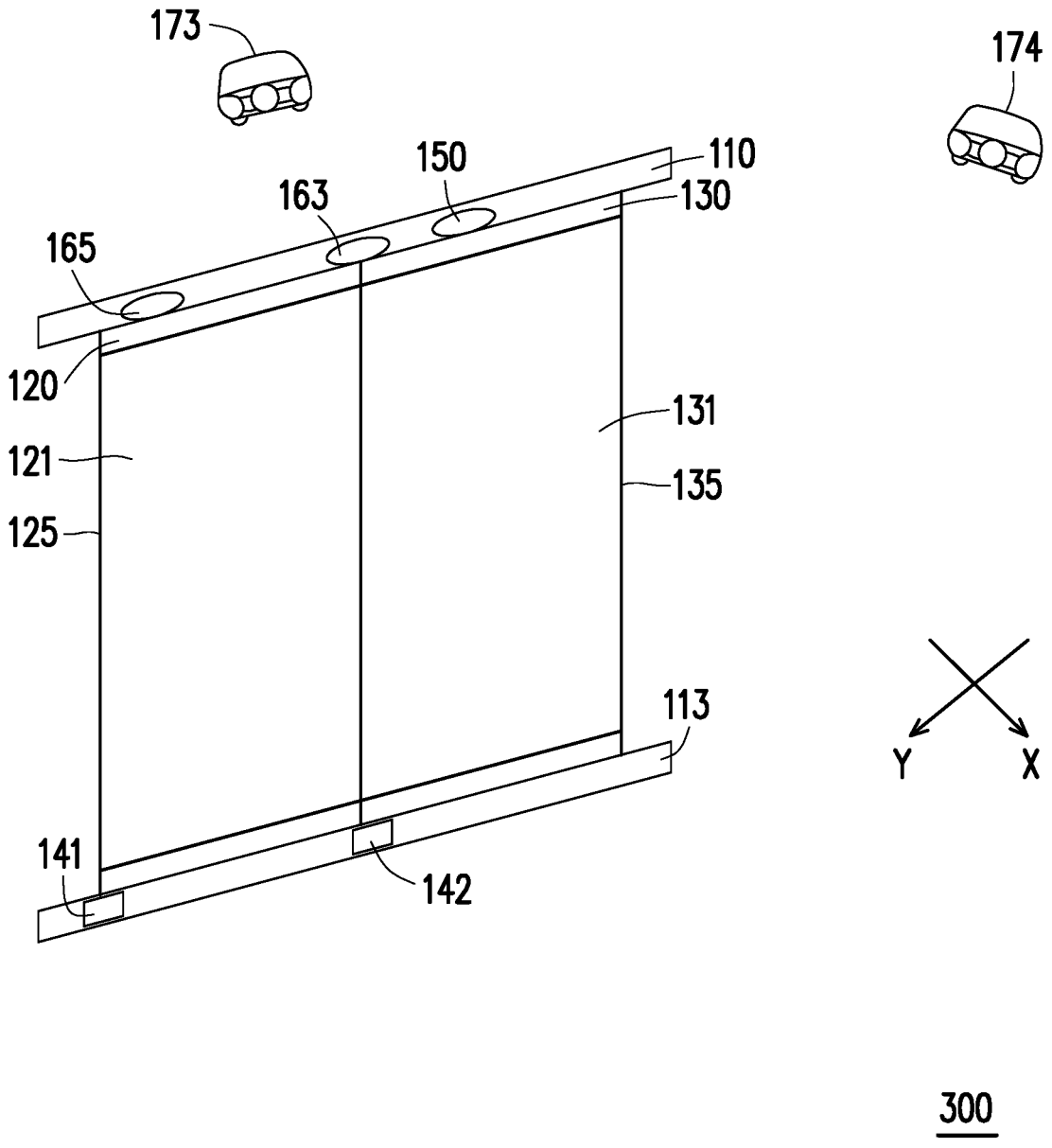
FIG. 10 is a schematic view of a space adjustment system according to a second embodiment of the present disclosure.

FIG. 10 is a schematic view of a space adjustment system 300 according to a second embodiment of the present disclosure. Referring to FIG. 10, the difference between the present embodiment and the first embodiment is that the depth camera 161 of the space adjustment system 300 is replaced with the distance sensor 163 and the wireless communication receiver 165, and the display panels 171 and 172 are replaced with the transparency-adjustable panels 121 and 131 (that is, the panels 125 and 135 of the present embodiment are implemented as the transparency-adjustable panels 121 and 131). In addition, the space adjustment system 300 further includes the first projection device 173 and the second projection device 174.

The distance sensor 163 is coupled to the control circuit 150. The distance sensor 163 may be an interrupted motion sensor (for example, an infrared (IR) sensor, an ultrasonic sensor, etc.), an image sensor, a touch sensor, or the like that can generate sensing value/data in response to the relative position of the external object/article.

The wireless communication receiver 165 is coupled to the control circuit 150. The wireless communication receiver 165 may be a receiver that supports wireless communication technologies such as Bluetooth, Infrared, ZigBee, Wi-Fi, and the like. In this embodiment, the wireless communication receiver 165 receives the wireless command signal sent by the smart phone, the tablet computer, and the remote controller of the user.

The first projection device 173 and the second projection device 174 are coupled to the control circuit 150. The first projection device 173 and the second projection device 174 may be any type of projector such as liquid crystal display, digital light processing (DLP) technique. In this embodiment, the first projection device 173 and the second projection device 174 are not directly disposed on the body 110 or the door leaves 120 and 130, and may be disposed on the wall or on the furniture in the located environment. The first projection device 173 is configured to project the first image in the first direction X. The second projection device 174 is configured to project the second image in the second direction Y, and the first direction X is perpendicular to the second direction Y.

Figure 11:
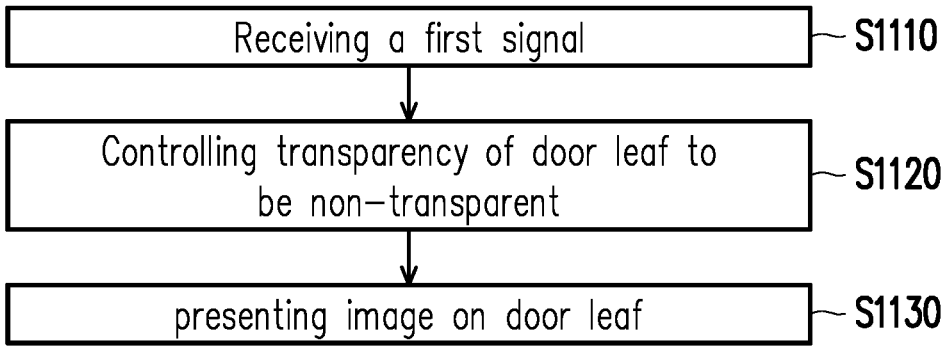
FIG. 11 is a flow chart of a control method according to a second embodiment of the present disclosure.

FIG. 11 is a flow chart of a control method according to a second embodiment of the present disclosure. Referring to FIG. 11, a remote controller or a mobile phone sends a first wireless command signal through Bluetooth communication technology, for example. The wireless communication receiver 165 receives the first wireless command signal (step S1110). This first wireless command signal is related to presenting image. On this occasion, the door leaves 120 and 130 are coplanarly closed. The control circuit 150 adjusts the transparency of the transparency-adjustable panels 121 and/or 131 on the corresponding door leaves 120 and/or 130 to be less than a threshold (for example, 30%, 20%, 5%, etc., the threshold in the embodiment is 0 (i.e., non-transparent)) according to the first wireless command signal (step S1120), and after the transparency of the transparency-adjustable panels 121 and/or 131 is adjusted to be less than the threshold, the first projection device 173 presents an image on the corresponding door leaves 120 and/or 130 (step S1130).

Figure 12:
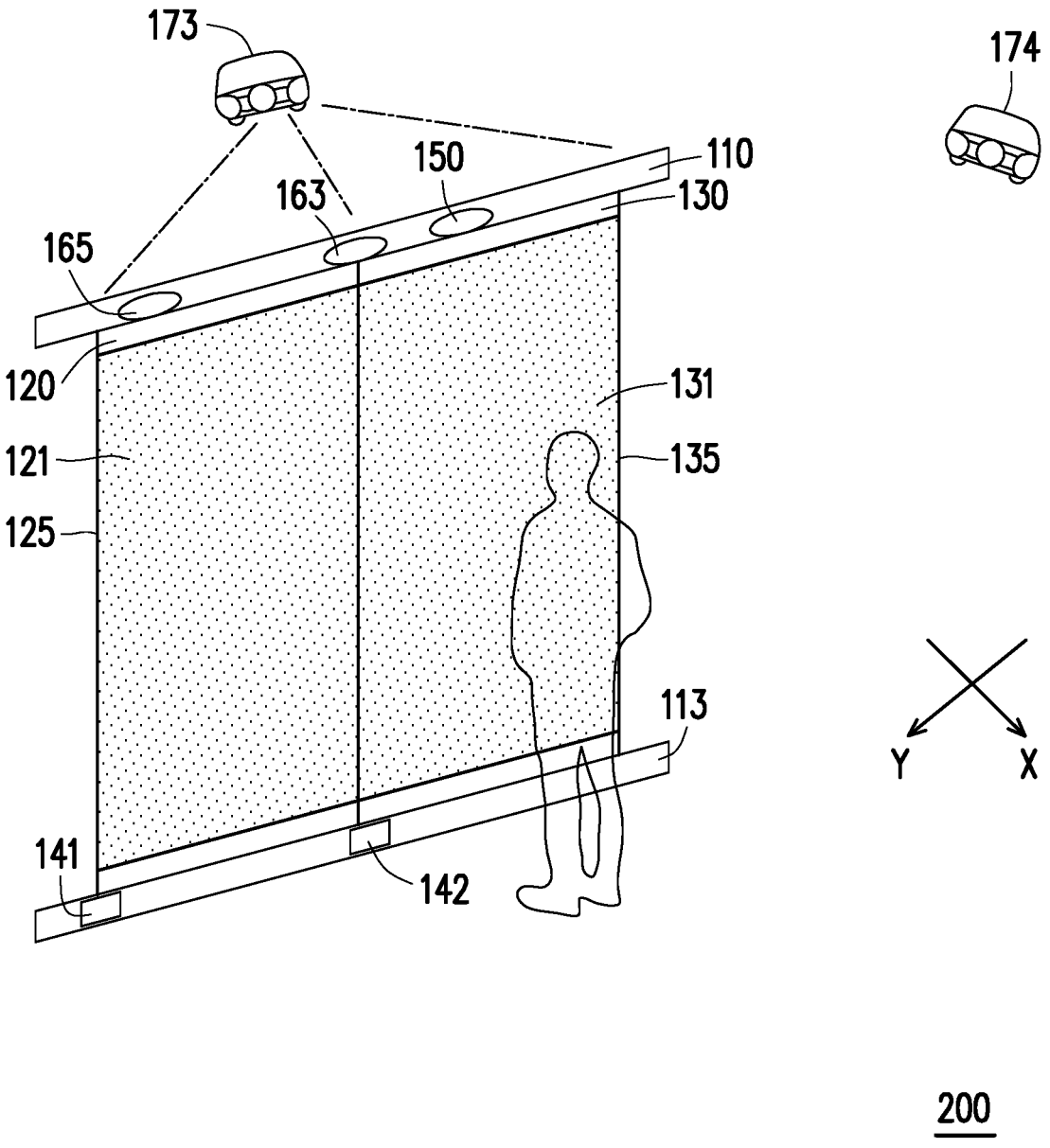
FIG. 12 is a schematic view of a space adjustment system according to a second embodiment of the present disclosure.

For example, FIG. 12 is a schematic view of a space adjustment system 300 according to a second embodiment of the present disclosure. Referring to FIG. 12, in response to the wireless command signal being related to presenting image, the transparency of the transparency-adjustable panels 121 and 131 is changed from completely transparent as shown in FIG. 10 to completely non-transparent. On this occasion, the two door leaves 120 and 130 are able to form an audiovisual space. The second projection device 174 cannot project an image onto any of the door leaves 120 and 130, so the projection of image is stopped.

Figure 13:
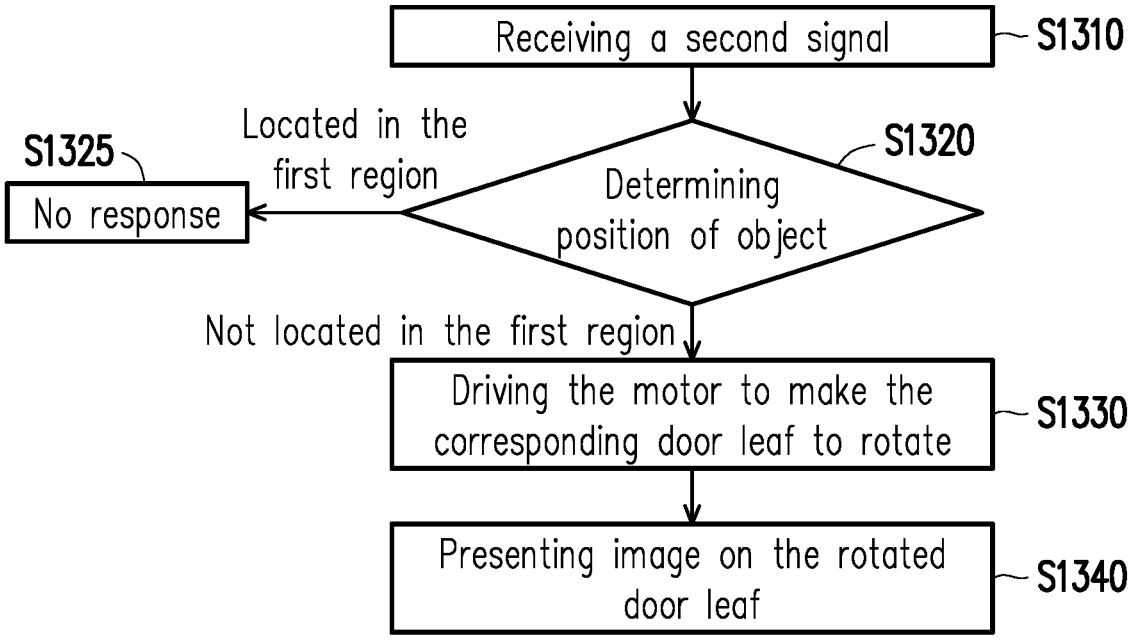
FIG. 13 is a flow chart of a control method according to a second embodiment of the present disclosure.

FIG. 13 is a flow chart of a control method according to a second embodiment of the present disclosure. Referring to FIG. 13, the present embodiment controls the space adjustment system 300 through the remote wireless technique. Specifically, a remote controller or a mobile phone sends a second wireless command signal, for example, via Bluetooth communication technology. The wireless communication receiver 165 receives the second wireless command signal (step S1310). The second wireless command signal is related to driving of door leaf (i.e., the first rotation command signal). Next, the control circuit 150 determines the position of the external object through the distance sensor 163 (step S1320). If the position of the external object is located in the first region (for example, the moving range of the door leaves 120 and/or 130), the space adjustment system 300 does not respond (step S1325) (on this occasion, the door leaves 120 and 130 are fixed, as shown in FIG. 12). If the position of the external object is not located in the first region, the control circuit 150 drives the motor 140 to make the corresponding leaves 120 and 130 to open (e.g., the door is opened rotationally in the embodiment) (step S1330). On this occasion, the door leaves 120 and 130 are vertically opened. The transparency of the transparency-adjustable panels 121 and/or 131 on the corresponding door leaves 120 and/or 130 has been adjusted to be less than the threshold, and the second projection device 174 can project/display the second image on the rotated door leaves 120 and/or 130 (step S1340). That is, the first and second projection devices 173, 174 simultaneously project images on the door leaves 120 and 130, respectively (the same or different images may be projected).

Figure 14:
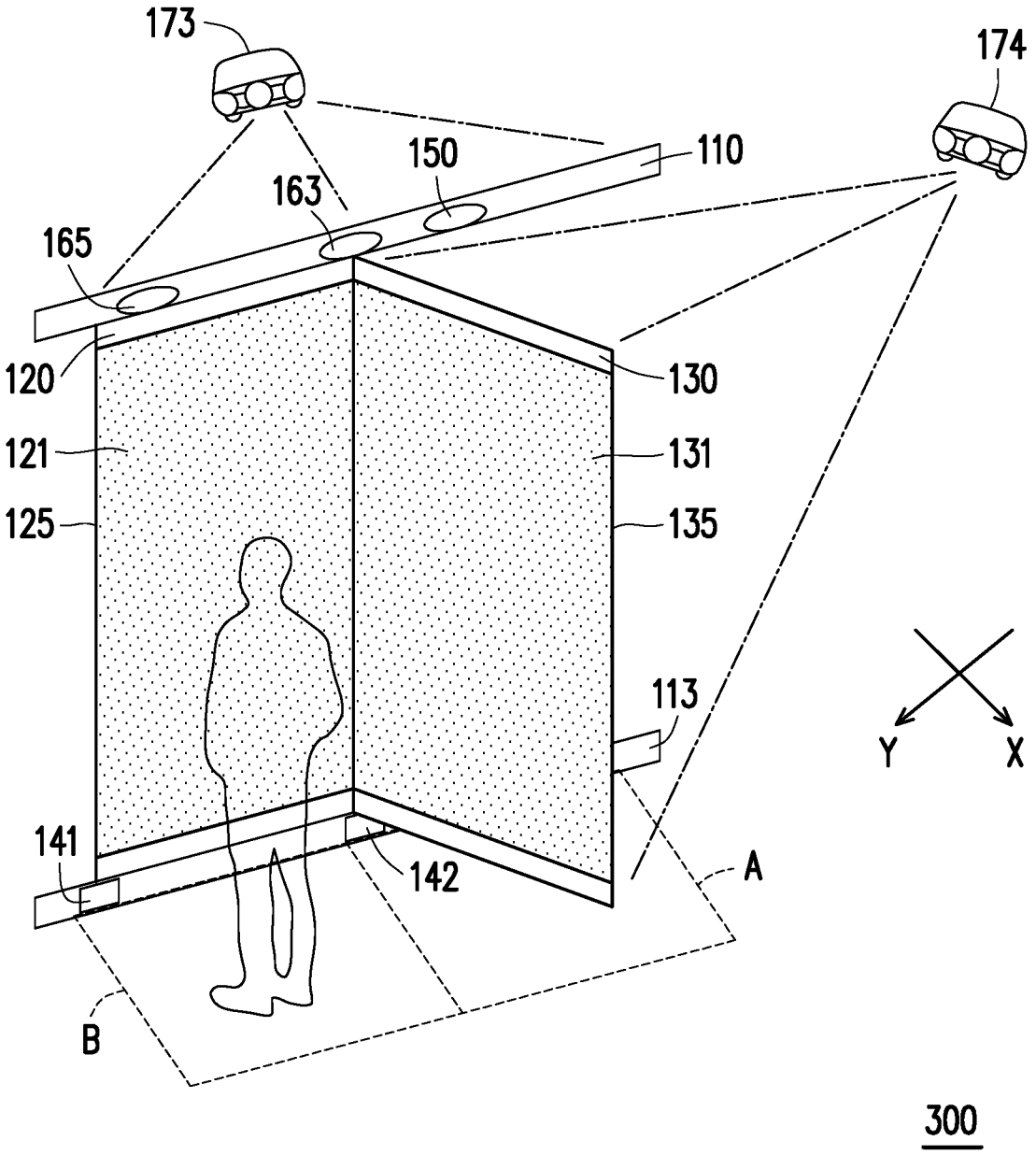
FIG. 14 is a schematic view of a space adjustment system according to a second embodiment of the present disclosure.

For example, FIG. 14 is a schematic view of a space adjustment system 300 according to a second embodiment of the present disclosure. Referring to FIG. 14, in the embodiment, the control circuit 150 further determines that the second wireless command signal corresponds to the door leaf 130, and determines whether the relative position of the external object is located in the moving range A of the door leaf 130, and does not determine whether the relative position of the external object is within the moving range B of the door leaf 120. As shown in the drawing, the control circuit 150 can confirm that the user is not located in the moving range A of the door leaf 130, and then the control circuit 150 drives the motor 142 to open the door leaf 130 rotationally in a clockwise direction, such that the door leaf 130 and the door leaf 120 are opened vertically. On this occasion, the door leaves 120 and 130 may form a shower space.

Figure 15:
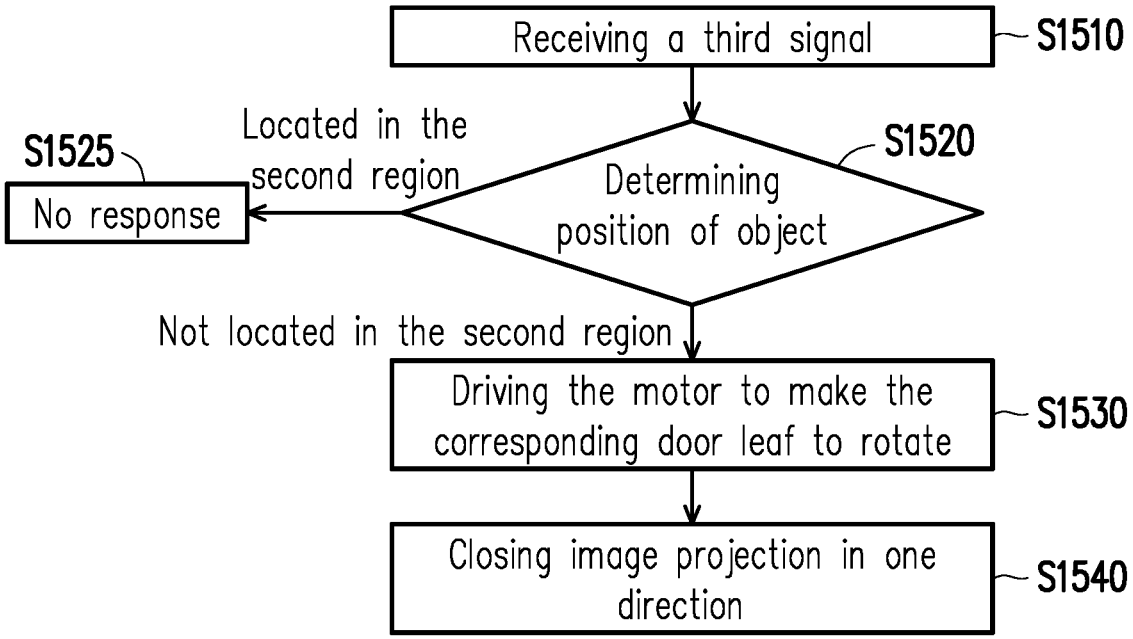
FIG. 15 is a flow chart of a control method according to a second embodiment of the present disclosure.

FIG. 15 is a flow chart of a control method according to a second embodiment of the present disclosure. Referring to FIG. 15, on this occasion, the door leaf 120 and the door leaf 130 are vertically opened (the door leaf 120 is perpendicular to the door leaf 130 as shown in FIG. 14). The remote controller or the mobile phone sends a third wireless command signal, for example, via Bluetooth communication technology. The wireless communication receiver 165 receives the third wireless command signal (step S1510). The third wireless command signal is related to driving of another door leaf (for example, the second rotation command signal). Next, the control circuit 150 determines the position of the external object through the distance sensor 163 (step S1520). If the position of the external object is in the second region (for example, the moving range of the door leaves 120 and/or 130), the space adjustment system 300 does not respond (step S1525). On the other hand, if the position of the external object is not located in the second region, the control circuit 150 drives the motor 140 to make the corresponding door leaves 120 and 130 to open (e.g., the door is opened rotationally in this embodiment) (step S1530). On this occasion, the door leaves 120 and 130 are opened in parallel. The transparency of the transparency-adjustable panels 121 and/or 131 on the corresponding door leaves 120 and/or 130 has been adjusted to be less than the threshold (if the transparency has not been adjusted, it is adjusted to be less than the threshold due to that the door leaves 120 and 130 are opened in parallel), and the control circuit 150 turns off the image projection of the first projection device 173 in the first direction X (step S1540). That is, projection of image is only performed by the second projection device 174.

Figure 16:
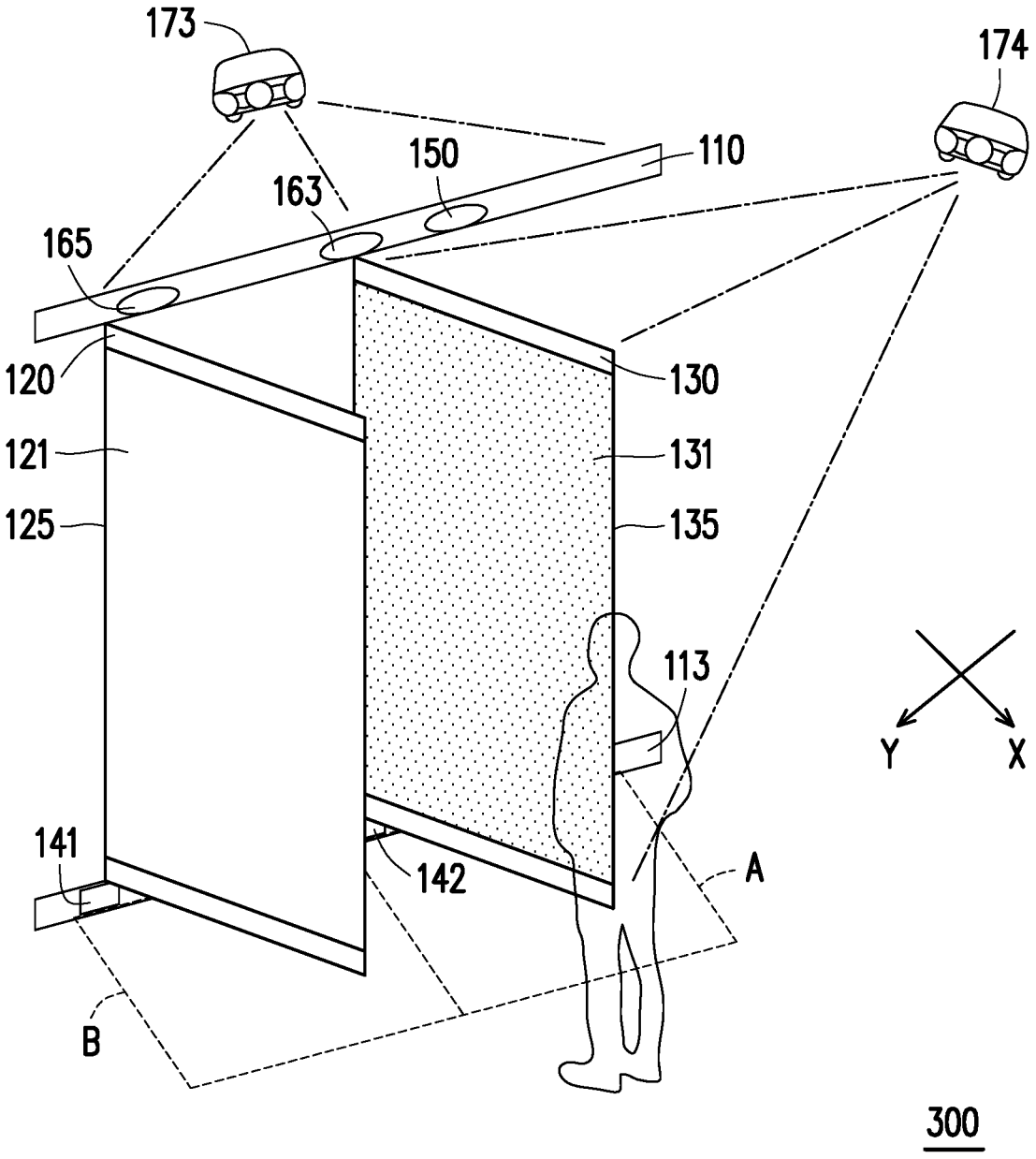
FIG. 16 is a schematic view of a space adjustment system according to a second embodiment of the present disclosure.

For example, FIG. 16 is a schematic view of a space adjustment system 300 according to a second embodiment of the present disclosure. Referring to FIG. 16, in the embodiment, the control circuit 150 further determines that the third wireless command signal corresponds to the door leaf 120, and determines whether the relative position of the external object is located in the moving range B of the door leaf 120, and does not determine whether the relative position of the external object is within the moving range A of the door leaf 130. As shown in the drawing, the control circuit 150 can confirm that the user is not located in the moving range of the door leaf 120, and the control circuit 150 drives the motor 142 to open the door leaf 120 in a clockwise direction, such that the door leaf 130 is parallel to the door leaf 120 (i.e., both of them are opened) and an accessible space is formed. On the other hand, the first projection device 173 may stop projecting the image. In addition, since the current position of the door leaf 120 causes the image of the second projection device 174 to be blocked by the door leaf 130 and cannot be presented on the door leaf 120, the control circuit 150 may also adjust the transparency of the transparency-adjustable panel 131 on the corresponding door leaf 130 to be greater than the threshold (e.g., 70%, 80%, 99%, etc.), or the transparency of the transparency-adjustable panel 131 remains unchanged.

It should be noted that the control circuit 150 may also close the door leaves 130 and/or 120 according to different wireless command signals, or adjust the transparency of the transparency-adjustable panels 121 and 131 (both or either one of them) to be larger than the transparency threshold (for example, 70%, 80%, 99%, etc.). In addition, the door leaves 120 and 130 of the first and second embodiments are all rotated with their left side as the axis, but may be rotated with the right side or the middle thereof as the axis in other embodiments, and even the axis may be switched to different sides.

In summary, the space adjustment system and the control method thereof provided in the embodiments of the present disclosure can create a plurality of different spatial patterns (through visual perception or the actual space is connected or isolated) by opening or closing the door leaf, changing the transparency of the transparency-adjustable panel on the door leaf and/or presenting images. Combined with presenting image, the user's visual experience can be enhanced. In addition, the device in the space adjustment system is driven by wireless remote control or motion control so that convenience of operation can be improved.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. A control method of space adjustment, comprising:

providing at least one door leaf, and at least one motor respectively driving the at least one door leaf, wherein the at least one door leaf is movable, and each of the at least one door leaf comprises a transparency-adjustable panel;

controlling the at least one motor to drive the at least one door leaf, comprising:

providing a distance sensor for sensing a relative position of an external object;

if the relative position of the external object is within a moving range of the at least one door leaf, disabling driving of the at least one door leaf; and if the relative position of the external object is not within the moving range of the at least one door leaf, driving the at least one door leaf; and adjusting transparency of the transparency-adjustable panel on the corresponding door leaf according to a position of the at least one door leaf.

2. The control method according to claim 1, wherein the step of controlling the at least one motor to drive the at least one door leaf comprises:

providing a depth camera for capturing at least one external image.

3. The control method according to claim 2, wherein the step of controlling the at least one motor to drive the at least one door leaf comprises:

determining motion of the external object in the at least one external image; and controlling the at least one motor to drive the at least one door leaf according to the motion of the external object.

4. The control method according to claim 3, wherein the step of controlling the at least one motor to drive the at least one door leaf comprises:

determining a second relative position of the external object in the at least one external image relative to the at least one door leaf;

if the second relative position of the external object is within the moving range of the at least one door leaf, disabling driving of the at least one door leaf; and if the second relative position of the external object is not within the moving range of the at least one door leaf, driving the at least one door leaf.

5. The control method according to claim 3, wherein the step of controlling the at least one motor to drive the at least one door leaf comprises:

determining that motion of the external object corresponds to a certain door leaf; and determining whether a third relative position of the external object is within the moving range of the certain door leaf.

6. The control method according to claim 5, wherein the step of adjusting the transparency of the transparency-adjustable panel on the corresponding door leaf comprises:

when the at least one door leaf is in a closed position, determining a fourth relative position of the external object in the at least one external image relative to the at least one door leaf; and if the fourth relative position of the external object is within the moving range of the at least one door leaf, adjusting the transparency of the transparency-adjustable panel on the corresponding door leaf to be less than a threshold.

7. The control method according to claim 1, wherein the step of controlling the at least one motor to drive the at least one door leaf comprises:

providing a wireless communication receiver for receiving a wireless command signal.

8. The control method according to claim 7, wherein the wireless command signal is related to driving of the at least one door leaf; and the control method further comprises:

controlling the motor to drive the at least one door leaf according to the first wireless command signal.

9. The control method according to claim 7, wherein:

the wireless command signal is related to presenting an image.

10. The control method according to claim 1, wherein the at least one door leaf comprises a first door leaf and a second door leaf, and the step of adjusting the transparency of the transparency-adjustable panel on the corresponding door leaf comprises:

providing a first projection device for projecting a first image in a first direction; and providing a second projection device for projecting a second image in a second direction, and the first direction is perpendicular to the second direction.

11. The control method according to claim 10, wherein the step of adjusting the transparency of the transparency-adjustable panel on the corresponding door leaf comprises:

when the first door leaf and the second door leaf are coplanarly closed;

adjusting the transparency of the transparency-adjustable panel of the first door leaf to be less than a threshold;

adjusting the transparency of the transparency-adjustable panel of the second door leaf to be less than the threshold;

projecting the first image onto the transparency-adjustable panel of the first door leaf and the transparency-adjustable panel of the second door leaf through the first projection device; and stopping projecting the second image through the second projection device.

12. The control method according to claim 10, wherein the step of adjusting the transparency of the transparency-adjustable panel on the corresponding door leaf comprises:

when the first door leaf and the second door leaf are vertically opened, adjusting the transparency of the transparency-adjustable panel of the first door leaf to be less than a threshold;

adjusting the transparency of the transparency-adjustable panel of the second door leaf to be less than the threshold;

projecting the first image onto the transparency-adjustable panel of the first door leaf through the first projection device; and projecting the second image onto the transparency-adjustable panel of the second door leaf through the second projection device.

13. The control method according to claim 10, wherein the step of adjusting the transparency of the transparency-adjustable panel on the corresponding door leaf comprises:

when the first door leaf is opened in parallel with the second door leaf;

adjusting the transparency of the transparency-adjustable panel of the second door leaf to be less than a threshold;

stopping projecting the first image through the first projection device;

projecting the second image onto the transparency-adjustable panel of the second door leaf through the second projection device.

14. A control method of space adjustment, comprising:

providing at least one door leaf, and at least one motor respectively driving the at least one door leaf, wherein the at least one door leaf is movable, the at least one door leaf comprises a first door leaf and a second door leaf, and each of the at least one door leaf comprises a transparency-adjustable panel;

controlling the at least one motor to drive the at least one door leaf; and adjusting transparency of the transparency-adjustable panel on the corresponding door leaf according to a position of the at least one door leaf, comprising:

providing a first projection device for projecting a first image in a first direction; and providing a second projection device for projecting a second image in a second direction, and the first direction is perpendicular to the second direction.

* * * * *